US005501025A

United States Patent [19]

Johnson

[11] Patent Number: 5,501,025

[45] Date of Patent: Mar. 26, 1996

[54] RETAINING SLING SWIVELS

[76] Inventor: David A. Johnson, P.O. Box 12204, Salem, Oreg. 97309

[21] Appl. No.: 332,700

[22] Filed: Nov. 1, 1994

[51] Int. Cl.[6] ..... F41C 27/00

[52] U.S. Cl. ..... 42/85; 224/150

[58] Field of Search ..... 24/2.5, 122.3; 42/85; 224/150

[56] References Cited

U.S. PATENT DOCUMENTS

| | | | |
|---|---|---|---|
| 2,057,881 | 10/1936 | Creamer | 24/122.3 |
| 4,562,945 | 1/1986 | Erlandson | 224/150 |
| 4,760,944 | 8/1988 | Hughes | 224/205 |

*Primary Examiner*—Stephen C. Bentley
*Assistant Examiner*—Christopher K. Montgomery
*Attorney, Agent, or Firm*—Marger, Johnson, McCollom & Stolowitz

[57] ABSTRACT

An improvement for retaining sling swivels on a firearm where web or narrow fabric is used in place of cord. Holes in an outer retaining piece and an inner cushioning piece can be of any shape. An extending projection may be used in the holes to conform the web or narrow fabric to the openings in the sling swivel.

In another embodiment, a wire may be enclosed in a closed web loop. A tab, which is folded and stitched, is formed adjacent to an outer retaining piece.

13 Claims, 1 Drawing Sheet

RETAINING SLING SWIVELS

BACKGROUND OF THE INVENTION

1. Field of the Invention

This invention relates to retaining sling swivels on a firearm and, more particularly, using web material to retain sling swivels on a firearm.

2. Prior Art

The prior art uses primarily cord material to retain sling swivels by means of loop locks or outer retaining piece. The cord is more difficult to attach to the sling and the interface is weaker than when web material is used. The cord is also more difficult to install through swivels.

SUMMARY OF INVENTION

An improvement for retaining sling swivels on a firearm where web or narrow fabric is used in place of cord. Holes in an outer retaining piece and an inner cushioning piece can be of any shape. An extending projection may be used in the holes to conform the web or narrow fabric to the openings in the sling swivel.

In another embodiment, a wire may be enclosed in a closed web loop. A tab, which is folded and stitched, is formed adjacent to an outer retaining piece.

DESCRIPTION OF THE PREFERRED EMBODIMENT

Figure 1:
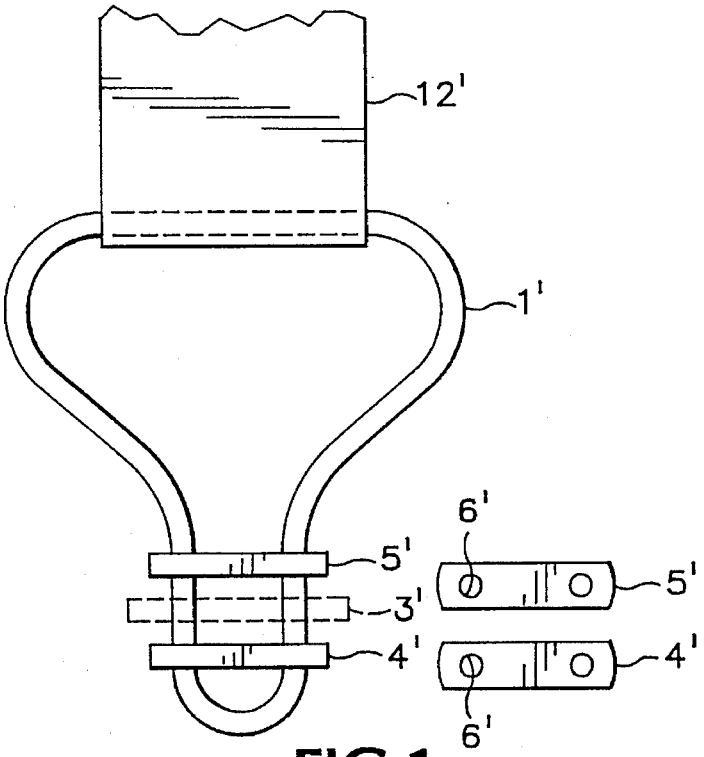
FIG.1 (PRIOR ART)
FIG. 1 shows the prior art in a front view showing the cord.
Figure 3:
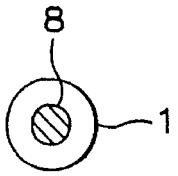
FIG. 3 shows the narrow fabric with insert along lines 3—3 of FIG. 2.
Figure 4:
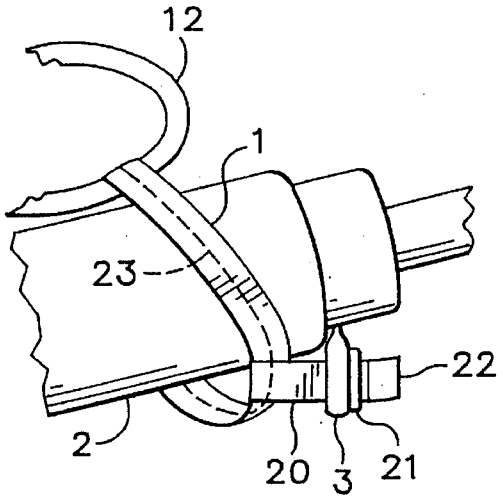
FIG. 4 shows another embodiment of the invention.
Figure 2:
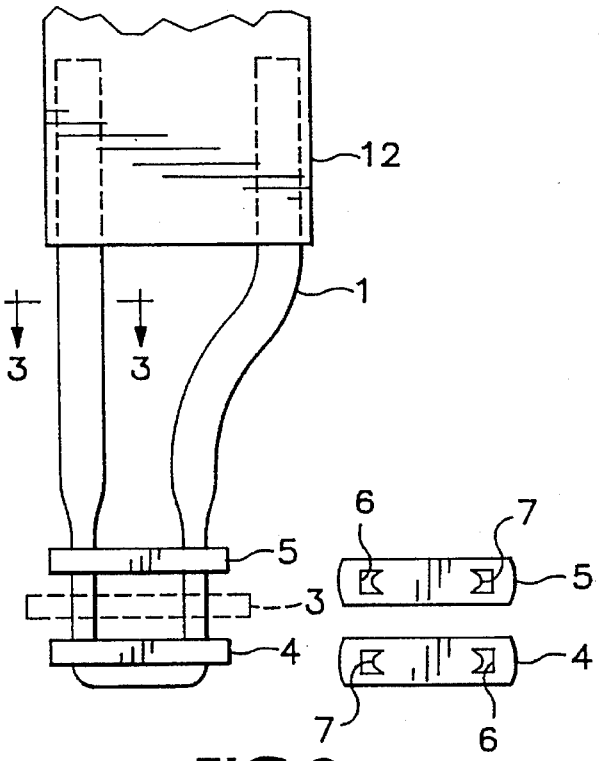
FIG. 2 shows the invention in a front view.

On a firearm 2 a sling 12 is attached by means of sling swivel 3. A closed narrow fabric loop 1 is attached to each end of the sling 12. The outer retaining piece 4 and the inner cushioning piece 5 are attached to the closed narrow fabric loop 1 before attachment to the sling 12. Each outer retaining piece 4 and inner cushioning piece 5 has two holes 6. The holes 6 may have an extending projection 7. The holes 6 may be of any shape, but a rectangular shape is preferred. The holes 6 also conform to said closed narrow fabric loop 1 to fit through sling swivel 3. The inner cushioning piece 5 prevents noise and damage to the firearm 2 by the sling swivel 3. The closed narrow fabric loop 1 can be hollow and an insert 8 can be used in the hollow tube.

In another embodiment the closed narrow fabric loop 1 is supplemented with material having a melting temperature greater than 500 degrees Fahrenheit. This narrow fabric loop 1 may be hollow with a wire 23 through the loop 1. A connector 20 is stitched and folded and looped through a buckle 21. The buckle 21 will pass through the swivel 3 but cannot be backed out unless manipulated. A pull tab 22 can be added to more easily pass the buckle 21 through the swivel 3.

I claim:

1. An apparatus for engaging a sling swivel for a firearm comprising:

a) a closed narrow fabric loop;

b) an outer sliding piece with two holes through which opposite sides of said closed narrow fabric are held; and c) an inner sliding piece with two holes through which opposite sides of said closed narrow fabric are held where said swivel is between said outer sliding piece and said inner sliding piece.

2. The apparatus of claim 1 where said holes of said inner and outer sliding pieces conform to said closed narrow fabric loop.

3. The apparatus of claim 2 where said holes of said inner and outer sliding pieces include an extending projection to conform said closed narrow fabric loop to fit through said swivel.

4. The apparatus of claim 1 where said closed narrow fabric comprises a hollow tube.

5. The apparatus of claim 4 where an insert is placed in said hollow tube.

6. An apparatus for retaining a sling swivel comprising:

a closed narrow fabric loop having a thickness;

an elongate body having top and bottom surfaces, two vertical holes, a width, a length and thickness;

said closed narrow fabric loop received in said two vertical holes so that a central portion of said fabric loop is adjacent the top surface of said body;

the body length, width and thickness and the fabric loop thickness selected so that the body and adjacent fabric loop central portion will pass lengthwise through a swing swivel and so that the body bottom surface will interlockingly engage the sling swivel.

7. An improved sling connector comprising:

(a) a closed narrow fabric loop which fits through a sling swivel;

(b) an outer retaining piece with two holes through which sides of said closed narrow fabric loop pass where said outer retaining piece is adjacent to said sling swivel; and (c) an inner cushioning piece with two holes through which opposite sides of said closed narrow fabric loop pass where said sling swivel is between said outer retaining piece and said inner cushioning piece.

8. The sling connector of claim 7 where said holes of said inner and outer pieces conform to said closed narrow fabric loop.

9. The sling connector of claim 7 where said holes of said inner and outer pieces include an extending projection to conform said closed narrow fabric loop to fit through said sling swivel.

10. The sling connector of claim 7 where said inner cushioning piece prevents a movable portion of said sling swivel from contacting a firearm connected to the swivel.

11. The sling connector of claim 10 where said inner cushioning piece prevents noise from said sling swivel contacting a firearm connected to the swivel.

12. The sling connector of claim 7 where said closed narrow fabric comprises a hollow tube.

13. The sling connector of claim 12 further comprising elongate in said hollow tube.

* * * * *